United States Patent [19]

Frick et al.

[11] Patent Number: 4,463,339

[45] Date of Patent: Jul. 31, 1984

[54] STATE/INTERVAL REDUNDANT CONTROLLER SYSTEM FOR TRAFFIC SIGNALS

[75] Inventors: Ralph E. Frick, 2740 Eliot Cir., Westminster, Colo. 80030; Nelson E. McNulty, Edgewater, Colo. 80214

[73] Assignee: Ralph E. Frick, Westminster, Colo.

[21] Appl. No.: 279,334

[22] Filed: Jul. 1, 1981

Related U.S. Application Data

[63] Continuation of Ser. No. 86, Jan. 2, 1979, abandoned.

[51] Int. Cl.[3] ..... G08G 1/07; G08G 1/097

[52] U.S. Cl. ..... 340/906; 340/931; 340/642; 340/916; 364/436

[58] Field of Search ..... 340/32–34, 340/41 R, 41 A, 35, 46, 641, 642, 663, 664, 40; 364/424, 436, 200 MS File, 900 MS File; 455/95, 99

[56] References Cited

U.S. PATENT DOCUMENTS

| | | | |
|---|---|---|---|
| 3,175,183 | 3/1965 | Willyard | 340/41 R |
| 3,482,208 | 12/1969 | Auer et al. | 340/35 |
| 3,638,179 | 1/1972 | Coll et al. | 340/32 |
| 3,810,084 | 5/1974 | Hoyt | 340/41 R |
| 3,818,429 | 6/1974 | Meyer et al. | 340/35 |
| 3,828,307 | 8/1974 | Hungerford | 340/35 |
| 3,840,847 | 10/1974 | Coll | 340/32 |
| 3,881,169 | 4/1975 | Malach | 340/32 |
| 4,135,145 | 1/1979 | Eberle | 340/46 |

*Primary Examiner*—James J. Groody
*Attorney, Agent, or Firm*—Kyle W. Rost

[57] ABSTRACT

Traffic signals at an intersection are controlled by one or more controllers of the state/interval type, located in the vicinity of the intersection. One or more remote units that are portable or mobile communicate with the controller via a coded signal to command specific light operations, instruct a secondary controller to take-over light control at the intersection from a primary controller, and to reprogram the operation of the controller on a temporary or permanent basis. The remote units generate a code that must be received accurately by the controller before commands are followed. In order to economically provide such a code, the code generator employs a diode matrix that orders data words and address words and is easily reprogrammed. The traffic signal indicator operation is monitored by the controller both to detect controller error, as by a voltage error resulting from an incorrect controller action, and to detect a non-controller error, as by a current error resulting from a burned out indicator. The controller may take different corrective action depending upon the nature of the error, including switching to another controller. An anti-coincidence logic circuit is connected between a state/interval controller and the light driver and disconnect.

10 Claims, 4 Drawing Figures

STATE/INTERVAL REDUNDANT CONTROLLER SYSTEM FOR TRAFFIC SIGNALS

This application is a continuation of application Ser. No. 86, filed Jan. 2, 1979 now abandoned.

BACKGROUND OF THE INVENTION

1. Field of the Invention

The invention relates generally to the field of electrical communications and specifically to traffic and vehicle communications. A traffic signal control system employs a controller and a plurality of remote control units, each having the capability of altering the normal sequence of traffic signal lights at an intersection. Each controller has the capability of acting as primary or secondary controller and can assume control from the primary controller when serving as the back-up unit.

2. Description of the Prior Art

Control of traffic signal lights has been undertaken by a variety of means extending from mechanical timers to computers. The fundamental goal of traffic light control is to accurately route cross-traffic through an intersection, and with increasing sophistication of control systems, it is the further goal to optimize traffic flow along an entire length of roadway. Also, an ideal traffic control system is able to accomodate special traffic conditions such as the passage of an emergency vehicle by anticipating the path of the vehicle and providing a clear right-of-way through all intersections. Although many systems have been proposed to meet these goals, few have found success. The primary causes for failure are that some systems are overly complicated for existing technology and therefore are unreliable or overly expensive, or others are too simple and may be tampered with by unauthorized persons for their own benefit.

The prior art includes U.S. Pat. No. 3,828,307 to Hungerford, relating to a central computer controlled system wherein the computer is linked by a telephone line to several remote terminals, each of which controls a traffic light. U.S. Pat. No. 3,881,169 to Malach discloses a traffic controller that is capable of detecting an audio signal from an emergency vehicle to alter the lights at the intersection in favor of the vehicle's right-of-way. U.S. Pat. No. 3,920,967 to Martin et al. teaches a computer controlled traffic light system wherein detectors monitor traffic flow and report to the computer so that traffic flow through a network of intersection traffic lights can be optimized. U.S. Pat. No. 4,016,532 to Rose suggests controlling the light latches associated with traffic light signals for emergency purposes by broadcasting a binary coded signal that is received and compared for a signal match, after which the light latch is operated. Finally, U.S. Pat. No. Re. 28,100 to Long and U.S. Pat. No. 3,831,039 to Henschel are relevant to a traffic light control system wherein a stroboscopic light on an emergency vehicle signals the vehicle approach to a traffic light, and various signal recognition safeguards in the light controller prevent unintended activation of the emergency control mechanism.

The above art indicates that the problems of providing right-of-way for an emergency vehicle have been dealt with through a variety of approaches; but in all cases the traffic light control system has to some extent required the emergency vehicle to make its presence known as distinguished from other vehicles. Traffic light controllers otherwise respond in a predetermined manner or within limited parameters to locally detected conditions, based on standard programming and operating sequences. The present invention seeks to expand the versatility of special purpose traffic light control by allowing remote control of traffic lights under circumstances of unusual local traffic flows.

A complex encoding method is proposed that on one hand will prevent unauthorized remote manipulation of traffic signals, while at the same time offering simplicity and low cost for establishing a new code in the event that an unauthorized use is discovered. Also, the reliability of traffic light controllers is increased through provision for redundancy of controllers.

SUMMARY OF THE INVENTION

In a traffic signal control system, primary and secondary controllers are capable of operating the cycles of the traffic light at a single location or intersection. At least one of the controllers is a state/interval controller operating the signal light through definition of individual states and intervals for each light, as compared to other controllers defining phases of operation. The controller monitors the performance of the individual lights to determine that operation is proper, and a secondary controller is capable of assuming control from the primary controller when uncorrected errors are discovered. One or more remote units may be in communication with the controller and are capable of assuming control of the controller to command temporary or permanent modification in the states and intervals created, and to command that the secondary controller take over control of the light. To prevent unauthorized persons from remotely controlling the system, a code generator in each remote unit employs a diode matrix to order the access code and data words being transmitted to the controller, which can be programmed to ignore any transmission that is not bit-perfect. Reprogramming the remote units for a new sequence of data words and address words involves altering the configuration of the diode matrix, which is simply and inexpensively done.

An object of the invention is to create a traffic light control system that is able to utilize complex encoding methods necessary to prevent unauthorized operation of a traffic light while being inexpensive, reliable, and small. It is likewise desired that the system have low power consumption, as is possible with radio frequency transmission between system components.

An important object is to improve the reliability of traffic light control systems through creation of a system that can monitor its own operation and correct errors either through alteration of light operating parameters or by shifting control from a maufunctioning controller to a reserve controller. By creating a system with a redundancy of controllers, this object is achieved, and, in addition, traffic disruption is avoided when one controller must be serviced. The back-up controller may take-over control of an intersection either automatically when it detects an error in light operation, or upon command through one of its communication channels.

Another important object is to allow authorized persons to remotely control the phases of traffic signals to meet the demands arising from special or unusual situations. Remote operation may include temporary overriding control of the controller by a remote unit, or permanent reprogramming of the controller from the remote unit.

A further object is to allow an emergency vehicle to assume the right-of-way at controlled intersection by an orderly yet prompt change in the operation of the light.

DESCRIPTION OF THE PREFERRED EMBODIMENT

System Structure

Figure 1:
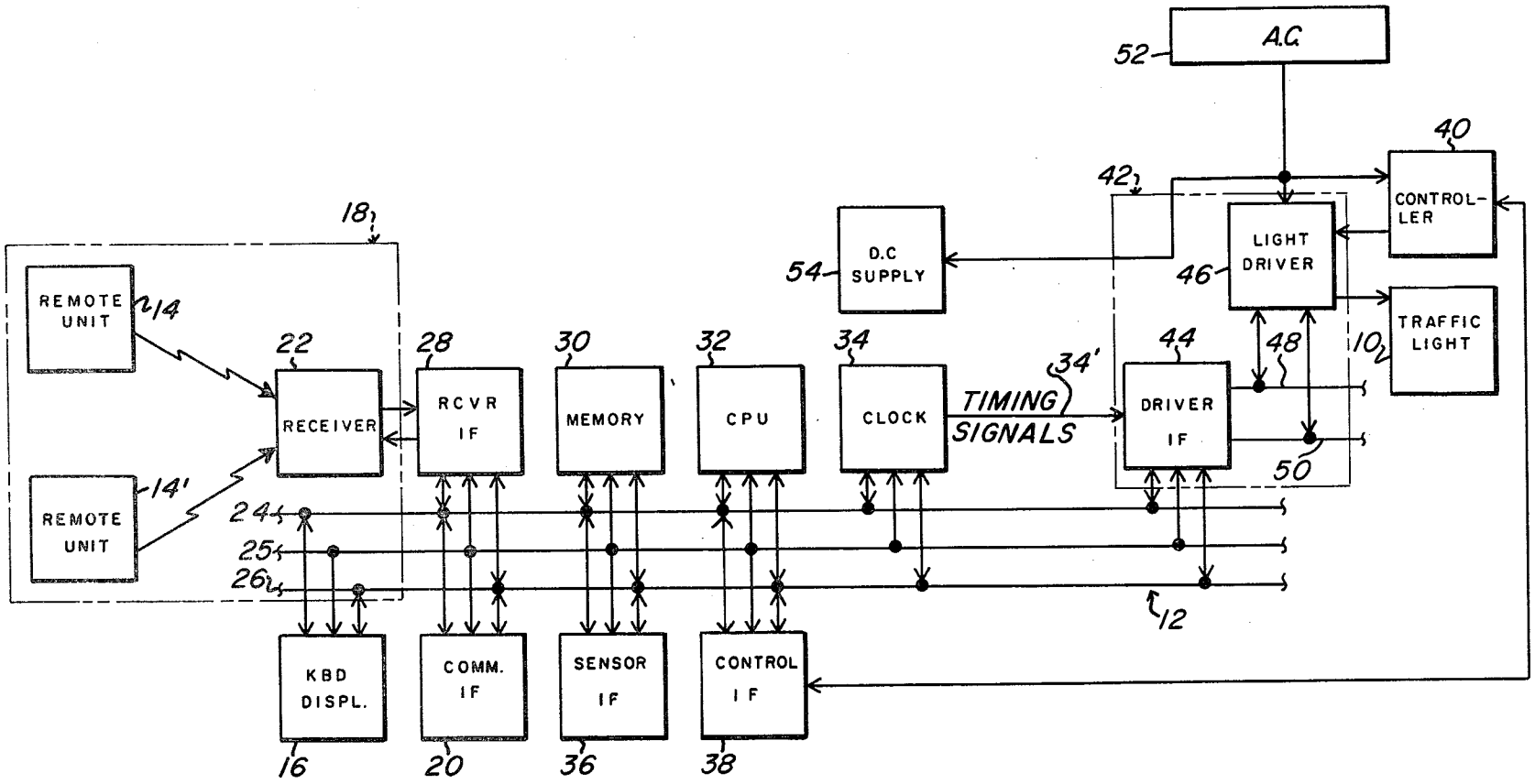
FIG. 1 is a block diagram of the traffic light control system.

The electronic traffic control system of the present invention may be understood by initial reference to FIG. 1, wherein the traffic light 10 is operated by means of a first controller 12, ordinarily located in the vicinity of the light, or plurality of lights, such as at a single intersection. In addition, the system employs one or more remote units 14, 14' that may be mobile, as installed in an emergency vehicle, or portable, for use over a period of time at a single controller location as required. Each controller 12 contains a microprocessor and has the ability to operate alone as a primary controller, in multiples as a primary controller with a back-up for fault or hazard override, or as an addition to an existing electronic controller of a different type. The remote units 14 operate by radio frequency communication or other wireless communication mode with the controller 12 and have the ability to control the controller. Each controller may also be operated by keyboard and display unit 16, and a remote control communications system 18 is also associated with the controller for communication with the remote units. In addition, the controller 12 may have associated therewith a communications interface 20 allowing the controller 12 to be joined to a central computer of an area wide traffic control system or to other controllers for intercommunication.

The remote control communications system designated generally as 18 in FIG. 1 may include two types of remote units 14. The uppermost unit 14 in the figure is of the type employed in an emergency vehicle for the purpose of notifying the controller that the vehicle is approaching the traffic signal and signalling the controller to assure that the vehicle receives right-of-way by means of a green signal light in the vehicle path. This controller is activated by a single switch to transmit a command for the green light by means of an access code to the controller. The lower remote unit 14' in the figure is portable and preferably hand held rather than vehicle mounted. This unit is employed to alter traffic light phases in order to accommodate abnormal situations at a single traffic light or intersection, or to reprogram a controller 12, or to command a secondary controller 12 to assume operation of the traffic light from a primary controller of the same or different type. Hence, the remote unit 14' requires more sophisticated controls than unit 14, although the primary difference would be in the programming as described below. Either remote unit transmits its communication to the remote control communication receiver 22 associated controller 12.

For purposes of illustration, the controller 12 is illustrated to be of the type having three logic busses: data buss 24, address buss 25, and control bus 26. Output and input between units connected to the busses is illustrated by means of arrows showing the direction of permissible communication. The remote control receiver communicates with remote control receiver interface 28, which provides the necessary circuitry to interface the remote communications channel to the controller busses. As the heart of the controller are the system memory 30, containing the programmed instructions and data necessary for operation of the controller, and the central processing unit or CPU 32. A real time calendar/clock 34 allows the controller to change cycles of the traffic light according to the time of day, day of the week or month, or other time parameter. The previously mentioned keyboard and display unit 16 is used to program the controller directly and to service it. Communications interface 20 may be adapted for use not only with wired units, but also fiber optics or other communication devices. A sensor interface 36 provides necessary circuitry to connect the controller to local sensors such as vehicle detectors or pedestrian crossing buttons. Control interface 38 provides necessary circuitry for communication with a second local controller 40, here designated as the primary controller although it could equally well be the secondary controller. In addition, controller 40 may be identical to controller 12, or it may be of a different variety that is nevertheless compatable for communication with controller 12.

The signal light driver system, designated generally as 42, communicates with controller 12 by means of light driver interface 44, permitting data and signals from the controller to be sent to the signal light drivers 46, via the light driver data buss 48 and control buss 50. Timing signals from clock 34 may be directly routed to interface 44 by circuit 34'. Light driver 46 then operates the traffic signal lights 10. Primary controller 40 also communicates with the light driver so that either first controller 12 or second controller 40, here designated as secondary and primary controller, respectively, can control the operation of the traffic signal light.

An AC power supply 52 is connected to the light driver and to each of the controllers 12 and 40. A system power supply 54 in controller 12 receives the AC power and converts it to DC, which is then supplied to each of the components of the controller in the known manner from a power bus. Each of the controller components is generally known and for this reason further explanation need not be provided with regard to the detailed internal composition and power connections.

Figure 2:
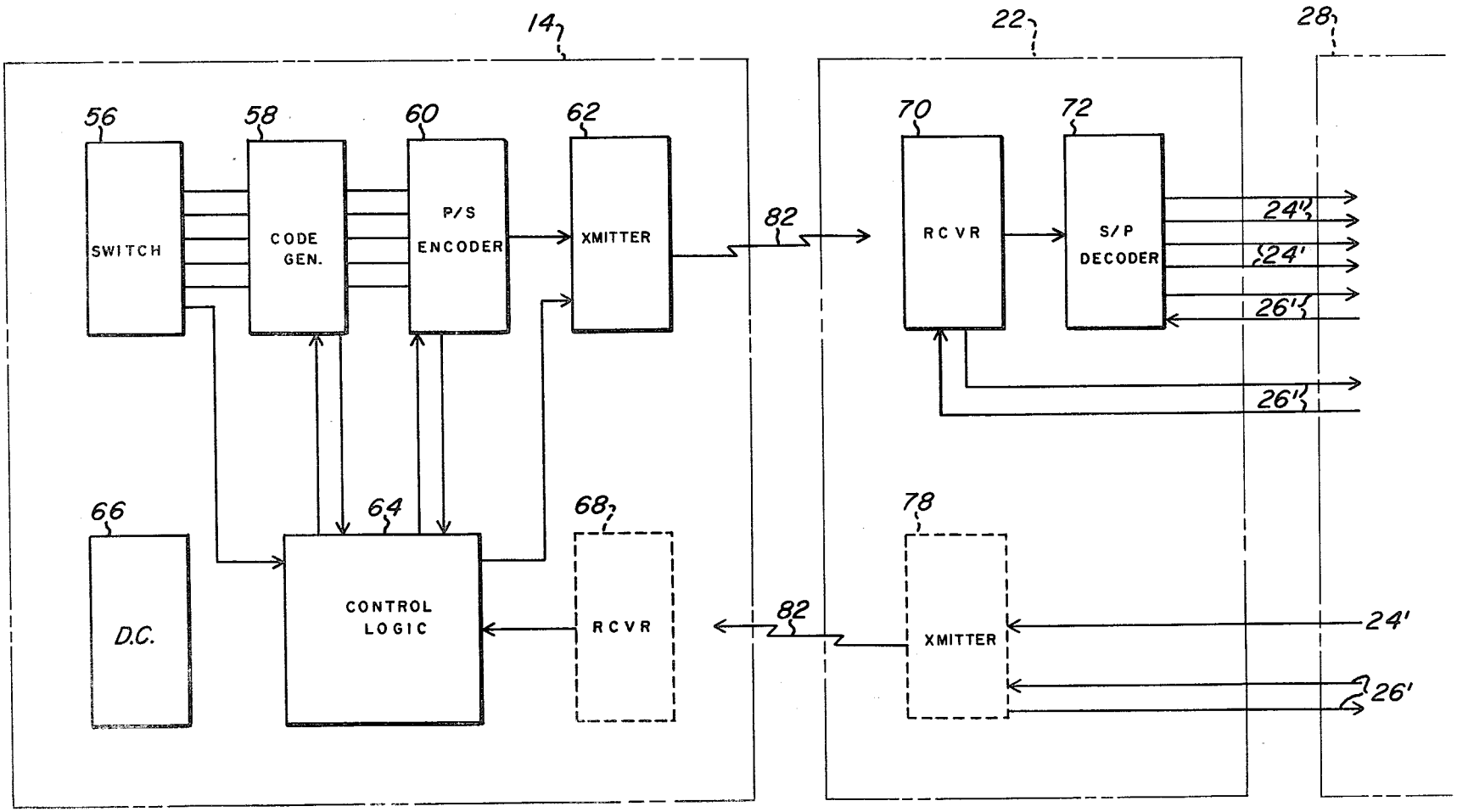
FIG. 2 is a block diagram of the remote control system of the traffic light control system of FIG. 1.

The remote control communications system 18 is shown in greater detail in FIG. 2, wherein only remote unit 14 is illustrated, although unit 14' is substantially identical. Each unit is provided with external switches 56 for manual activation to supply control signals to the code generator 58, which supplies an appropriate output via multiline connection to parallel-to-serial encoder 60, which in turn communicates a signal to transmitter 62, which in turn transmits the signal to receiver 22. The types of signal are variable according to the specific purpose of the remote unit. As previously observed, a single access code is all that may be required for the emergency vehicle embodiment. However, for a portable remote unit, it may be desirable for several switches to provide different commands to the controller. For example, one command may direct that a specific traffic light at an intersection turn green while another command may require that all lights turn red. Still another command may activate the first controller 12 to take over operation from the controller 40. The control logic 64 is joined to units 56-62 in order to make the remote unit 14 function. A DC power supply 66 provides necessary current to each other component of the remote unit, and in the case of a remote unit 14, this power supply would likely be the vehicle battery. If a transponder type of operation is desired or necessary for security purposes, a receiver 68 may be included in the remote unit.

The remote control communications receiver 22 includes a radio frequency receiver 70 adapted to receive the transmission from transmitter 62. The output from the receiver 70 goes to a serial-to-parallel decoder 72, which returns the data to parallel format and sends it via multiline data curcuits 24' to the interface circuit 28 for interface to the controller busses 24–26. Generally the receiver 70 and decoder 72 each both receive and forward control signals via control circuits 26'. A transmitter 78 may optionally be included in the receiver 22 in those instances when receiver 68 is desired in the unit 14. The transmitter receives data via its circuit 24' and both receives and forwards control signals via its circuits 26'. Although radio frequency signals 82 are indicated to be the mode of communication between the various receivers and transmitters, as noted above, other communication media may be employed.

The signal light driver system 42 plays a critical role in the overall operation of the controller, which is a state/interval controller as compared to a phase controller. A phase is defined as the time period for a movement of traffic. In a phase controller, a phase is completely defined in terms of individual intervals set up on individual controls. Multiple phases can then be set up to define a complete cycle. In the state/interval controller, only the state of the individual light, that is, whether the light is on or off, and the time interval for that state is defined. Individual states or intervals can be grouped together to form phases and cycles, but the primary difference is that the phases and cycles can be changed at each interval in the state/interval controller, as opposed to having to follow a specific sequence as in a phase controller.

Figure 3:
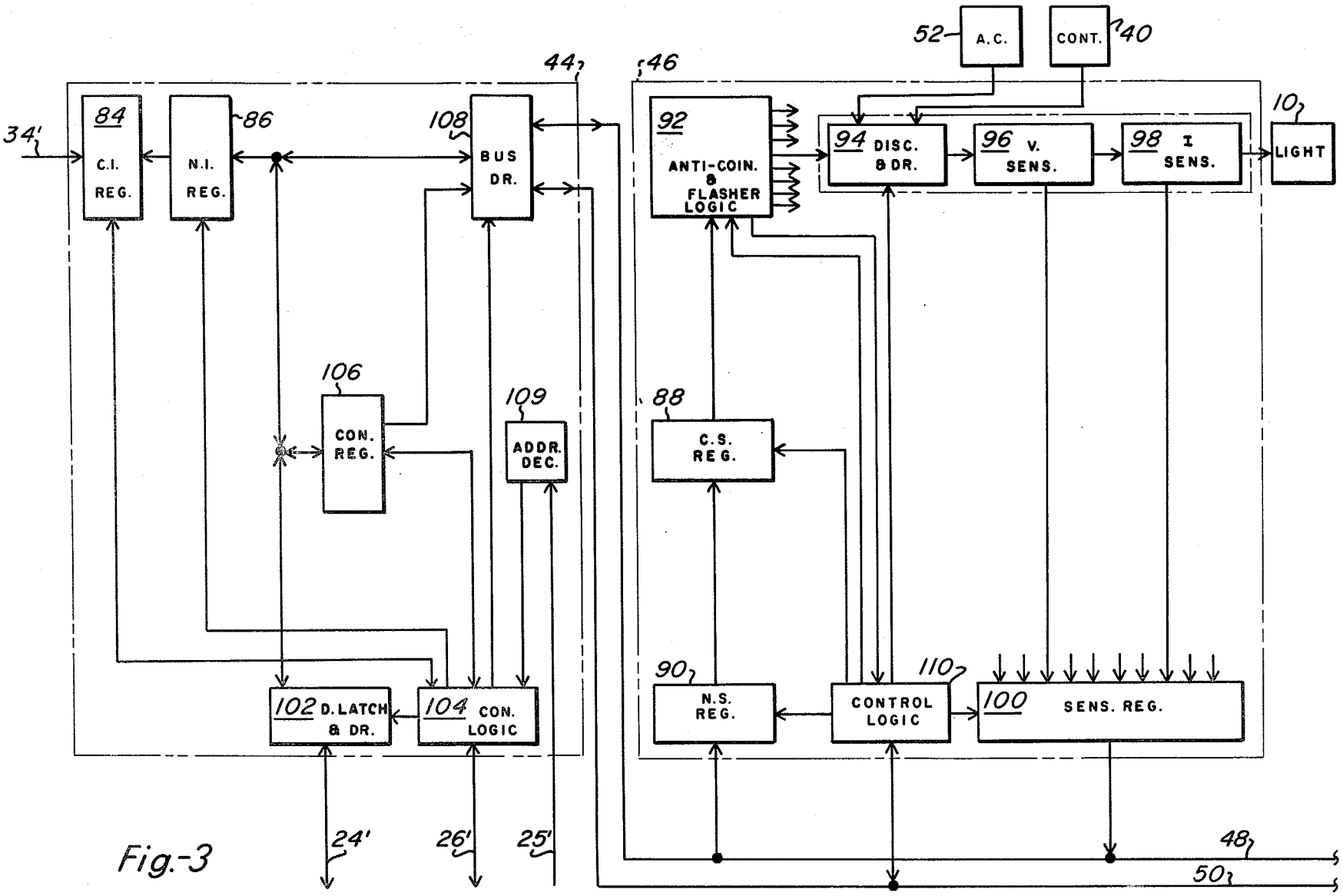
FIG. 3 is a block diagram of the traffic signal driver system of the traffic light control system of FIG. 1.

With reference to FIG. 3, the light driver interface is designed to anticipate two potential problems in a state-/interval controller. First, each state/interval must be defined and loaded at interface 44 for each operation. There is inherently a time lag in setting up new states due to the time of defining and loading, and it may be anticipated that after a great number of cycles these errors accumulate and may result in unsynchronized light operation. In order to eliminate this possibility, the light driver interface 44 is designed to include a current interval register 84 directly receiving the timing signals via circuit 34'. A next interval register 86 is connected to register 84. In the light driver, a current state register 88 and a next state register 90 are operatively connected. At any instant, a state and an interval will be set up in the current state and current interval registers, respectively. Before the current interval is terminated, the controller will load the next state and next interval data into the appropriate registers from system memory. Upon termination of the current state and interval, the data in the next state and next interval registers will be transferred automatically to the respective current registers. The controller is then notified of the transfer and it will again load the next state and interval registers from memory. Since the minimum practical time for any one state of the signal lights is several seconds, the controller can perform numerous instructions if necessary during that time period in order to calculate the next state, in accordance with its programming.

Because of the rapid change of states in the state/interval controller, which are on the order of microseconds, the controller loses very little time and consequently is more accurate than other types of controllers.

The second potential problem that has been anticipated is that there is no inherent hazard or anticoincident detection and prevention in the state/interval controller. As a result, it would be possible to have simultaneous green lights for crossing traffic. A user selectable anti-coincidence logic and flasher logic 92 are therefore located immediately before the actual light drivers, as represented by disconnect and driver circuit 94. Eight such circuits 94 may be connected to the signal logic circuit 92, as indicated by the plural arrows exiting the circuit.

Each light driver circuit 94 is associated with a voltage sensor 96 and current sensor 98, both of which are in communication with sensor registers 100, the latter registers receiving input from all eight of sensors 96 and 98 associated with the eight individual light driver circuits 94. Together, the sensors 96 and 98 and registers 100 sense the state of the actual power going to the signal lights 10 and allow the controller to read and compare the results with data in memory. Thereby, the controller 12 is able to detect errors by the primary controller 40 and, by appropriate programming, to disconnect the primary controller and take over control of the intersection. Further capability includes the ability for the controller 12 to detect its own errors and shut itself off, or it may determine that a light has burned out and set up a different sequence to temporarily bypass the problem.

Other elements of the light driver interface include data latches and drivers 102, control logic 104, control register 106, bus drivers and receivers 108, and address decoder 109 on address circuit 25'. Circuit 102 is connected for two way communication between the controller data bus via 24', while control logic 104 is connected for two way communication to the control bus via 26'. Circuit 108 is connected for two way communication to both the data bus and the control bus of the light driver busses 48 and 50. In the light driver 46, the control logic 110 is connected for two way communication with control bus 50, while the register 90 receives input from the data bus 48 and sensor registers 100 output data to the data bus 48. The input connection to disconnect and driver circuit 94 from second controller 40 has also been shown in FIG. 3, on the assumption that controller 40 is compatable with the light driver 46.

System Operation

The controller 12 is configured and operates like an ordinary computer. The CPU 32 responds to inputs from the system memory 30, and to interrupts from the interfaces, and it also follows programmed instructions as would any computer. Therefore, specific hardware operation may be assumed to be standard. The software employed is important and will be described in terms of how the controller is initially setup and how it handles different types of inputs and preprogrammed cycles.

Initial Setup

Initial setup may be simplified by having software to run the controller plus a start-up light cycle in a read-only memory (ROM), since this type of memory is non-volatile. The ROM adds a degree of reliability to the controller, although the read-and-alter memory (RAM) is supplied with stand-by power so that it will retain information in a primary power failure.

After power at a new installation has been turned on, the installer keys in the information necessary to operate the controller efficiently at the particular intersection. This information is unique to each intersection and consists of instructions on how to handle the inputs from the sensors interface 36, the control interface 38, the communications interface 20, and the remote control interface 28; instructions on checking the inputs from the light state sensors to determine if a problem exists; and all of the different intervals or state/interval combinations that make up the different light cycles that will be referenced according to the instructions entered.

When the above information has been entered, the controller is instructed to operate with the information, and the installer is free to monitor and modify operation as necessary without disturbing the controller's operation.

Operational Examples

Operational examples for the controller may be treated in the form of independently operating functions, since there is little inter-relationship in the full functioning system.

A. Primary Controller—At a simple intersection consisting of two crossing streets with one lens in each direction, there will be presumed to be no walk lights or turn lights. Tables I and II below illustrate two sections of memory having importance in this situation, a Table of Address Vectors and a Table of State/Interval Information:

I. Table of Address Vectors

| Address | Contents | Use | Comments |
|---|---|---|---|
| 0010 | 1000 | Beginning Address | Normal |
| 0012 | 1007 | Ending Address | Cycle |
| 0014 | 1008 | Beginning Address | Special |
| 0016 | xxxx | Ending Address | Cycle |

II. Table of State/Interval Information

| Address | Contents | Use | Comments |
|---|---|---|---|
| 1000 | 30 Seconds | Interval | Normal |
| 1001 | E-W red, N-S green | State | Cycle |
| 1002 | 5 Seconds | Interval | |
| 1003 | E-W red, N-S yellow | State | |
| 1004 | 45 Seconds | Interval | |
| 1005 | E-W green, N-S red | State | |
| 1006 | 5 Seconds | Interval | |
| 1007 | E-W yellow, N-S red | State | |
| 1008 | | Interval | Special |
| 1009 | | State | Cycle |
| 100A | | etc. | |
| 100B | | | |
| 100C | | | |

At initial activation of the controller, the ROM instructs the CPU to load the contents of address 0010 (in hexadecimal notation) into the address register as the beginning address. The CPU then causes the information located at the beginning address to be sent to the driver interface 44. The first word coming from the memory is the time interval that is loaded into the next interval register 86. The second word is the state information that is loaded via the light driver buss 48 into the next state register 90. If there are a plurality of light drivers 46, then each succeeding word is loaded into the next state register of each succeeding driver, in turn; however, it is presently assumed that only one driver 46 is present.

The current interval register 84 will be decreasing in accordance with signals from the clock 34, and when it reaches zero, the data in the next interval register 86 and the next state register 90 will be loaded into, respectively, the current interval register 84 and the current state register 88. In the current state register, logic ones (1's) in the state word cause the corresponding light to be turned on. The current interval register simultaneously starts to count-down to zero.

The CPU increments the address for the state/interval information with each word transfer to the driver interface and checks each new address to see if it equals the ending address for the cycle, expressed as 1007 in the table of address vectors. If it does, then the CPU will reload the beginning address and start over. If not, then each new request from the driver interface will cause succeeding state/interval information to be transferred to it. The driver interface will thus receive the interval and state information first from addresses 1000 and 1001, then 1002 and 1003, then 1004 and 1005, and then 1006 and 1007, completing one timing cycle for the traffic lights. Note that the phases, which may be defined in the example as addresses 1000–1003 and 1004–1007, have little meaning in this system.

In table I, addresses starting at 1014 contain the beginning and ending addresses for other cycles that may be required when inputs to the system are acknowledged. For example, upon reception of the emergency vehicle right-of-way command from remote unit 14, a special cycle described below is required.

An error signal is generated at the light driver 46 in the event of conflicting light activations. For example, if north and west bound lanes received simultaneous green lights, the controller will attempt to reload the proper state into the drivers 46. If the problem is not corrected, the controller may be programmed to switch to a special cycle, or to relinquish control to another controller, or to shut itself off. If one of these methods does not eliminate the error, then the control logic 110 will force an all-red condition in the intersection lights.

B. Remote Control Input Signals—Four types of remote control signals may exist, including (1) emergency vehicle right-of-way requests; (2) non-emergency control of lights; (3) special cycle programming; and (4) a command for the secondary controller to assume control. These are received in special formats that the controller decodes and tests before recognizing that the data is valid.

In the case of the emergency vehicle right-of-way request, the controller will take over control of the intersection without abrupt change in the light cycles, as might confuse vehicles near the intersection. The current state is interrupted and a yellow traffic light is actuated to stop moving traffic. The interrupt time and yellow light time are programmable. A short all-red interval follows the yellow interval, after which the controller goes directly to the special cycle in memory, which will be loaded into the light drivers. At the end of the special cycle, the controller resynchronizes the lights and returns to the original cycle.

When a non-emergency remote control signal is received, the controller ignores all pre-programmed cycles and instead receives interval and state commands from the remote unit. At the termination of the remote commands, the controller resynchronizes the traffic signal lights to the original cycle.

A remote unit may also transmit a special cycle programming signal, causing the controller to load the new information into its memory, change or add the appropriate beginning and ending addresses to the table I, and then make a transition to the new cycle when commanded to do so. The new information may be either a temporary or permanent change.

Upon reception of a command from the remote unit to take over control from another controller 40, the controller 12 will send a signal to the control interface 38 to cut off the primary controller 40. Controller 12 will then enable the drivers 46 to complete the switchover from primary to secondary controller.

C. Operation in Automatic Take Over Mode—In connection with each driver circuit 94 are sensors 96 and 98 that determine whether the light is receiving power and drawing current. If power is present but no current is drawn, this indicates a burned out light bulb and the controller will implement a special cycle to minimize the effect of the lost light, or, if a hazard is created, the controller will lock into a flashing state to eliminate the hazard.

The CPU checks the state of the lights and the identity of those receiving power against a programmed table of states in memory. If a state is not correct or if the primary controller sticks on an interval, the secondary controller 12 will assume control of the intersection as explained above. However, if the secondary controller is already in control and the fault is therefore its own, it will attempt corrective action while acting as the primary controller, as explained above.

D. Sensor Inputs—Sensors may detect vehicle presence or pedestrian crossing light requests. The controller may respond to sensor inputs by jumping to special cycles, transmitting the information to a master controller, totalling the occurrences, jumping to a routine for calculation of special interval times that will supercede the normal interval times, or some combination of these responses. The controller may either substitute new time intervals in the state/interval portion of memory 30 or it may directly interact with the register 84 to cause it to terminate a state early or extend a state when necessary, as when new timing intervals are to be calculated and the cycles changed in accordance with the cycle changing procedure previously described.

E. Communications System—Three types of communications includes (1) synchronization of the traffic signal light 10 to a master controller to produce fixed offsets; (2) exchange of information with a master controller, and (3) the reprogramming or altering of cycles. Incoming communication signals at interface 20 must be decoded and tested for proper format, and the CPU must encode and format outgoing signals in order to gain recognition from the master controller.

Lights are synchronized by having the CPU impress a new time interval on the current interval register. Information exchange with a master controller would be designed for a specific application. Reprogramming cycles is accomplished as previously described.

F. Clock Input—The real time clock 34 is of the type able to recognize uniquely the year, months, day, hour, and second. Part of the supervisory routine in the software is to read out this information and test it with information in the RAM. Thus, the controller may be programmed to change cycles in accordance with time variables.

Remote Control Unit Operation

Each remote control unit 14 or 14' operates by transmitting a code to the controller 12. The code used and the method of its generation are designed for the security and reliability of the system. The control information is transmitted in the form of groups of twelve bit digital words that are in bit-serial, word-serial format. Each twelve bit word is in a standard format that allows eight bits for variable data and reserves the remaining four bits for synchronization and error testing for the individual word.

Each group of transmitted words comprises either one of two variable bit data words which contain instructions for the controller and one or more fixed bit address words. The location of the instruction (data) words in the group and the bit patterns of the address words are programmed via a matrix located in the code generator 58 and can be easily reprogrammed should it become necessary. The code genrator circuit is discussed below.

When the group of words is received by the controller, it is compared bit by bit with the programmed standard. If any bit in the entire group does not agree with the predetermined pattern, the controller ignores the entire group and waits for further inputs. The bit perfect requirement for the received groups is the key to the system's security. Anyone attempting unauthorized control of the system must know the code and transmit the control group perfectly in order to succeed. Furthermore, if the system is violated, the code generator matrix and the comparison words in the controller can be reprogrammed to foil further unauthorized use.

The coding method produces the negative side effect of decreasing the reliability of system operation when noise exists in the communication channel; however, the same group of words may be repeated to increase the probability that at least one group will be received bit-perfect. System security and control information accuracy are increased by requiring that any n received groups out of n+m transmitted identical groups be received bit-perfect and then cross-checking the bits in the variable words.

Figure 4:
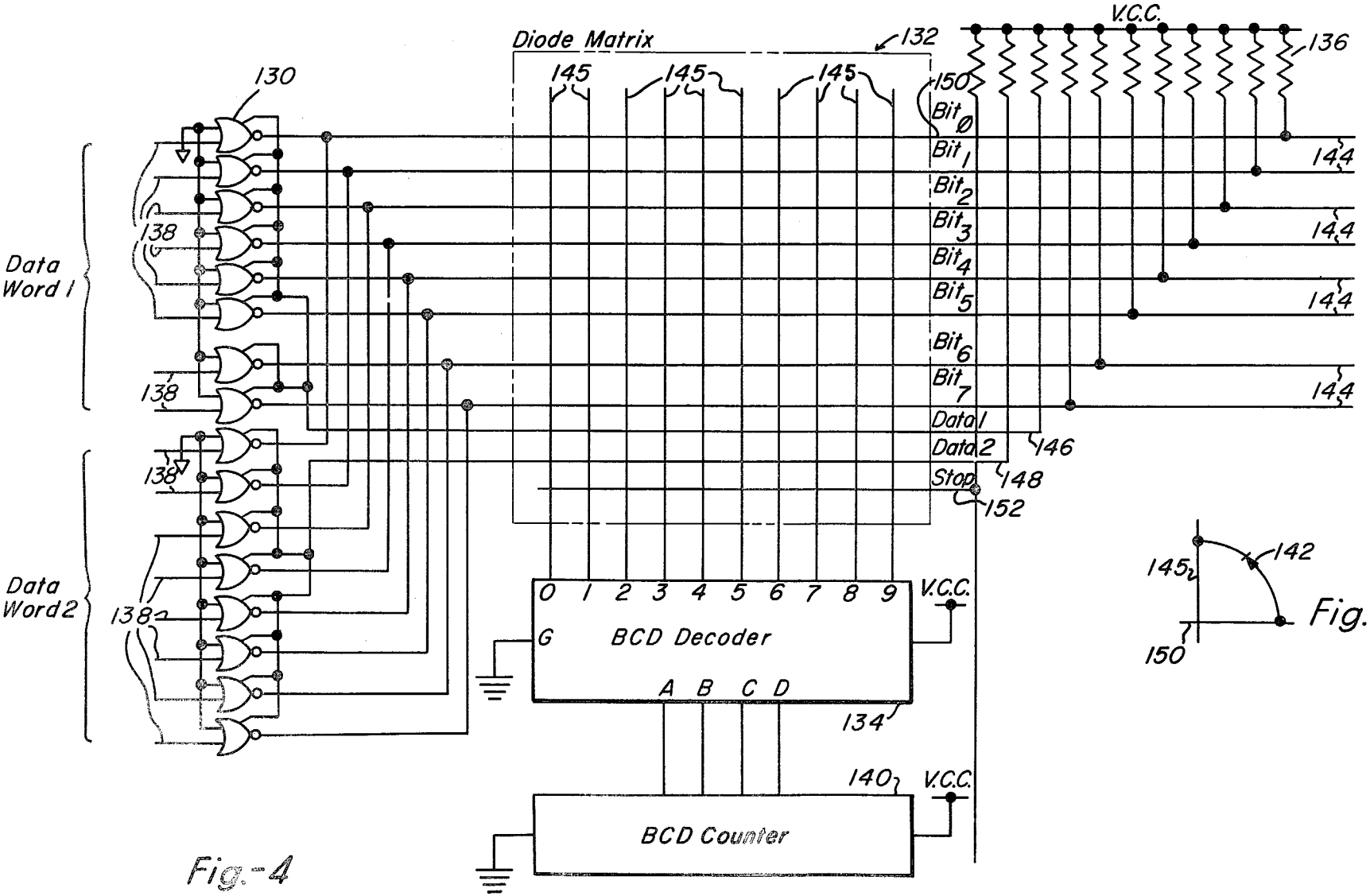
FIG. 4 is a schmetic diagram of the code generator of FIG. 2.
Figure 5:
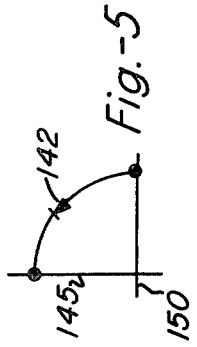

The code generator of FIG. 4 includes the data gates 130, the diode matrix 132, BCD decoder 134, and the pull-up resistors 136. At the start of the transmission sequence, data from the switches 56, FIG. 2, is placed on the appropriate gate input lines 138 at the left hand side of FIG. 4. The upper eight gates 130 in the figure provide the first data word, while the lower eight gates provide the second data word. BCD counter 140 receives control signals from the control logic 64, FIG. 2, and the counter sequences the diode matrix by sending control signals to the terminals A, B, C, and D of the BCD decoder. The outputs from the BCD decoder to the matrix are activated one at a time, and the data selected by the diodes 142, FIG. 5, is put onto the lines 144 to the parallel-to-serial encoder 60, FIG. 2. The coding function of the matrix is programmed by placing a diode at the cross-points of the matrix. A diode placed at the junction of any of the ten decoder output lines 145, which are extending upwardly from the BCD decoder, and either the Data 1 line 146 or Data 2 line 148 will cause the appropriate gates to open, allowing the information from the data switches to go to the parallel-to-serial encoder. Diodes placed at the junctions of the decoder outputs 145 and the bit lines 150, labelled Bit 0 (zero) through bit 10, will program the fixed address words and their sequence. A diode placed at the junction of any decoder output line 145 and the stop line 152 will cause the code generator to stop when that line is activated, thus determining the maximum number of words to be transmitted in each group. One word is transmitted for each decoder output line activated until the stop signal is received by the control logic 64.

The diode matrix permits variable data words and fixed address words to be transmitted in any order and allows easy reprogramming when necessary. The circuit illustrated in FIG. 4 limits the maximum number of words transmitted in each group to ten; however, this is not a serious limitation since it provides considerable security and could be easily expanded if required for a particular application. If an unauthorized person should obtain a remote unit or if the code is otherwise duplicated, all remaining remote units may be reprogrammed by altering the diode locations in the diode matrix or simply replacing the matrix. The controller memory is then reprogrammed by software techniques in accordance with the new diode matrix configuration, efficiently excluding the unauthorized person from further controlling a controller, while at the same time requiring only a small expenditure of labor and materials.

We claim:

1. A traffic signal control system for operating an associated at least one traffic signal of the type having a plurality of indicators, comprising in combination:

(a) a first state/interval controller generating commands for the operation of a plurality of traffic signal indicators of an associated traffic signal through definition of individually selected states and definition of an individual time interval to be associated with each individual state for each indicator; said controller including a clock means supplying time pulses for use by the controller in determining the end of a defined time interval associated with a defined indicator state, and a storage means for containing said individually selected current signal indicator state data and current interval definition data, wherein the controller determines the termination of the stored current interval in said storage means in response to time pulses received from said clock means, in response to said determined termination of the current interval generates an operating command for terminating said stored current state, individually selectes a next state and next interval, and loads said next state and next interval into said storage means; and (b) signal light driver means operatively connected to said first controller for receipt of operating commands from the controller and operation of traffic signal indicators in response thereto wherein said storage means comprises:

a current interval register containing time data relating to an immediate state of a traffic signal indicator, having operative communication with said clock means and said signal light driver means; and a current state register containing the identity of the immediate light state and in operative connection to the signal light driver means; and further comprising:

a next interval register containing time data relating to the state following the current state of the traffic signal indicator, having operative connection to said current interval register for loading the next interval time data after conclusion of the immediate light state, and having operative connection to said first controller for receiving subsequent interval time data; and a next state register containing state identity data for the signal indicator in the interval following the immediate interval, having operative connection to said current state register for loading the next state data after conclusion of the current state, and having operative connection to said first controller for receiving subsequent state data.

2. The traffic signal control system of claim 1, wherein said first controller further comprises a remote unit communication receiver means, wherein the control system further comprises at least one remote control unit having signal generating means and communication transmitter means for communicating a generated signal to said receiver means, said remote control unit comprising means for programming said first controller.

3. The traffic signal control system of claim 2, wherein said programming means comprises data word and access word sequencing means.

4. The traffic signal control system of claim 3, wherein said sequencing means comprises:

(a) a plurality of data gates connected to said signal generating means for supplying a variable bit data word in response to generating signals;

(b) a diode matrix having connected to said data gates at least one data line, a plurality of bit lines, and a stop line, and having a plurality of decoder output lines crossing the stop, data, and bit lines with diodes at selected intersections;

(c) a decoder connected to the decoder output lines for selected individual activation of the output lines; and (d) a pull-up resistor attached to each of said stop, data, and bit lines.

5. A traffic signal control system for operating at least one traffic signal of the type having a plurality of signal indicators, comprising in combination: first and second redundant controllers, each comprising a central processing means, a memory means, and a light driver interface means; and a signal light driver means having associated therewith a means for sensing voltage and means for sensing current to the individual signal indicators; wherein (a) said central processing means is adapted to interpret and execute instructions for the operation of the signal indicators, is connected to said light driver interface means for receiption of present voltage and current indicating data from the signal light driver means and for communication of signal indicator operating instructions to the signal light driver means, is connected to said memory means for receipt of reference voltage and current indicative data corresponding to a present operational routine for the signal indicators and for receipt of selected instructions for further operation of signal indicators;

(b) said memory means is adapted to store instructions and data and is connected to said central processing means for communication of said instructions and data, wherein said memory means contains at least (1) first instructions designating initial priority of the first controller as between said first and second controllers, (2) second instructions designating a first operational routine for the signal indicators, (3) reference data of current and voltage indicative information corresponding to said first operational routine, (4) third instructions designating at least one alternate operational routine for use in response to a variation between reference and present current indicative data, (5) fourth instructions designating at least in the memory means of said second controller a switch of controller priority to the second controller, for use in response to a variation between reference and present voltage indicative data; and (c) said signal light driver means is operatively connected to said light driver interface means for receipt of commands for operation of signal indicators from the central processing means and return communication of present voltage and current indicating data to the central processing means; and (d) said central processing means being further adapted to compare present voltage and current indicative data to reference voltage and current indicative data and to select operational instructions from said memory means in response to the comparison results.

6. The traffic signal control system of claim 5, further comprising communications interface means for communicating priority information between said first and second controllers.

7. The traffic signal control system of claim 5, further comprising at least one remote control unit having means for generating a signal and means for transmitting the generated signal to at least one of said controllers, wherein said one controller further comprises a communications receiver means for receiving the generated signal from said remote control unit and communicating the signal to the central processing means, and wherein said memory means further contains instructions designating an alternate operational routine for use in response to receipt of the generated signal at said central processing means.

8. The traffic signal control system of claim 7, wherein said remote control unit further comprises a code generator and a parallel-to-serial encoder, said code generator receiving input from said signal generating means and sending output in parallel to said parallel-to-serial encoder, which, in turn, communicates the signal to said transmitting means; and said communications receiver means further comprising a series-to-parallel decoder in communication with said central processing means.

9. The traffic signal control system of claim 5, wherein said signal light driver means further comprises:

(a) a signal light disconnect and driver means operatively connected to the signal indicators for the operation thereof through said voltage sensing means and current sending means;

(b) a sensor register operatively connected to the voltage sensing means and current sensing means for receiving voltage and current indicative data therefrom and monitoring actual present signal indicator operation, said sensor register being in communication with at least one central processing means for transmittal of indicator operation data; and (c) an anti-coincidence logic means operatively connected between said at least one central processing means and said disconnect and driver means next preceding said last mentioned means for preventing undesired simultaneous states in the traffic signal indicators.

10. The traffic signal control system of claim 5, wherein each of said controllers comprises a real time calendar/clock means in intercommunication with said central processing means for providing time data; and wherein said memory means further contains instructions designating an alternate operational routine for use in response to receipt of specified real time data at said central processing means.

* * * * *